US010393051B2

(12) United States Patent
Fukuda et al.

(10) Patent No.: US 10,393,051 B2
(45) Date of Patent: Aug. 27, 2019

(54) INTERNAL-COMBUSTION-ENGINE FUEL INJECTION CONTROL DEVICE

(71) Applicant: Hitachi Automotive Systems, Ltd., Hitachinaka-shi, Ibaraki (JP)

(72) Inventors: Takao Fukuda, Hitachinaka (JP); Hideyuki Sakamoto, Hitachinaka (JP); Masahiro Toyohara, Hitachinaka (JP); Yoshihisa Fujii, Hitachinaka (JP); Osamu Mukaihara, Hitachinaka (JP); Mitsuhiko Watanabe, Hitachinaka (JP); Takeshi Konno, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 121 days.

(21) Appl. No.: 15/023,560

(22) PCT Filed: Jun. 13, 2014

(86) PCT No.: PCT/JP2014/065675
§ 371 (c)(1),
(2) Date: Mar. 21, 2016

(87) PCT Pub. No.: WO2015/045503
PCT Pub. Date: Apr. 2, 2015

(65) Prior Publication Data
US 2016/0208725 A1 Jul. 21, 2016

(30) Foreign Application Priority Data
Sep. 27, 2013 (JP) ..... 2013-200778

(51) Int. Cl.
*F02D 41/20* (2006.01)

(52) U.S. Cl.
CPC ..... *F02D 41/20* (2013.01); *F02D 2041/2013* (2013.01); *F02D 2041/2048* (2013.01);
(Continued)

(58) Field of Classification Search
CPC ..... F02D 41/20; F02D 2041/2048; F02D 2041/2058; F02D 2041/2013; F02D 2041/2051
See application file for complete search history.

(56) References Cited

U.S. PATENT DOCUMENTS 4,355,619 A * 10/1982 Wilkinson ..... F02D 41/20 123/478
6,031,707 A 2/2000 Meyer
(Continued)

FOREIGN PATENT DOCUMENTS

DE 198 21 561 A1 11/1999
DE 10 2012 207 947 A1 11/2012
(Continued)

OTHER PUBLICATIONS

International Search Report (PCT/ISA/210) issued in PCT Application No. PCT/JP2014/065675 dated Sep. 16, 2014 with English translation (Four (4) pages).
(Continued)

*Primary Examiner* — David Hamaoui
(74) *Attorney, Agent, or Firm* — Crowell & Moring LLP

(57) ABSTRACT

An internal-combustion-engine fuel injection control device which can accurately control a boosted voltage applied to a fuel injection valve during fuel injection and can control a variation in a fuel injection amount without increasing a size or a cost of the fuel injection control device even when a width of a fuel injection driving pulse to drive the fuel injection valve is small is provided. A fuel injection control device includes a boosting operation control unit configured to start a boosting operation at predetermined timing regardless of an amount of a detected voltage when the detected
(Continued)

voltage is higher than a threshold voltage for starting boosting and is lower than a threshold voltage for stopping boosting.

10 Claims, 10 Drawing Sheets

(52) U.S. Cl.
CPC ..... *F02D 2041/2051* (2013.01); *F02D 2041/2058* (2013.01)

(56) References Cited

U.S. PATENT DOCUMENTS 8,126,094 B2 * 2/2012 Komaili ..... H04L 27/3809 375/345
2012/0197512 A1 * 8/2012 Yamada ..... F02D 41/20 701/105

FOREIGN PATENT DOCUMENTS

DE 102012207947 A1 * 11/2012 ..... F02D 41/20
JP 2003-161193 A 6/2003
JP 2012-159025 A 8/2012
JP 2013-64363 A 4/2013
JP 2013064363 A * 4/2013
JP 2013-142346 A 7/2013

OTHER PUBLICATIONS

Extended European Search Report issued in counterpart European Application No. 14848423.1 dated Apr. 5, 2017 (Four (4) pages).

* cited by examiner

INTERNAL-COMBUSTION-ENGINE FUEL INJECTION CONTROL DEVICE

TECHNICAL FIELD

The present invention relates to an internal-combustion-engine fuel injection control device. For example, the present invention relates to an internal-combustion-engine fuel injection control device to inject fuel into a combustion chamber by opening a fuel injection valve with a booster circuit.

BACKGROUND ART

Conventionally, a technology of directly injecting fuel into a cylinder has been practically used as a technology of fuel injection to an internal-combustion-engine.

Also, recently, since it is requested to make exhaust gas cleaner and to improve fuel efficiency, power, and the like, fuel injection into a cylinder is divided into a plurality of times (multi stage injection) and downsizing to combine a supercharger with an internal-combustion-engine and to reduce displacement, is in progress. Thus, in order to deal with the minimum output to the maximum output of the internal-combustion-engine, a further expansion of a dynamic range from the minimum injection amount to the maximum injection amount of a flow characteristic of a fuel injection valve is desired.

For such an expansion of a dynamic range of a flow characteristic of a fuel injection valve, for example, it is necessary to increase the maximum injection amount by expanding a hole diameter of the fuel injection valve or to open a valve element for a very short period in a region of the minimum injection amount. Thus, it is necessary to close the valve element before it is fully opened, that is, to use an intermediate lift state.

On the other hand, in a case of opening the fuel injection valve and of injecting fuel into a cylinder, injection of high-pressure fuel and high responsivity are required. Thus, it is required to apply high voltage to the fuel injection valve and to apply high current. Thus, in a fuel injection control device to control fuel injection, a booster circuit to generate high voltage from a battery voltage is generally included.

The fuel injection control device accumulates the high voltage generated in the booster circuit into a charge accumulation element such as a capacitor and consumes the charge during the fuel injection. Then, in order to perform next fuel injection in a stable manner, the fuel injection control device completes a boosting operation with the booster circuit until the next fuel injection and recovers desired voltage. Here, when a boosted voltage becomes lower than a certain threshold, the fuel injection control device starts the boosting operation. When the voltage reaches a desired threshold, the fuel injection control device completes the boosting operation.

More specifically, as illustrated in FIG. 8, by applying current to a coil of a fuel injection valve 105', the above-described conventional fuel injection control device 127' controls an amount of fuel necessary for combustion. Specifically, in an internal-combustion-engine to directly inject fuel into a cylinder, in order to defeat high-pressure fuel and to deal with high responsivity, the fuel injection control device 127' generates high voltage in an internal part thereof by performing boosting from voltage of a battery 1' and supplies the generated high voltage to the coil of the fuel injection valve 105' in a case of opening the fuel injection valve 105'.

More specifically, a booster circuit includes a power supply of the battery 1', a boosting coil L1, a switching element for boosting T1, a boosting diode D1, and a boosting capacitor C1. The fuel injection control device 127' applies current to the boosting coil L1 by turning the switching element for boosting T1 on during boosting. By turning the switching element for boosting T1 off after energy is accumulated into the boosting coil L1, the fuel injection control device 127' accumulates the energy, which is accumulated into the boosting coil L1, into the boosting capacitor C1 through the boosting diode D1. By turning the boosting switching element T1 on/off intermittently until a predetermined voltage is reached in the boosting capacitor C1, the fuel injection control device 127' controls the generated voltage.

The voltage of the boosting capacitor C1 is monitored, by a comparator for recognizing a stop of boosting Comp1. The fuel injection control device 127' compares the voltage in the boosting capacitor C1 and a threshold voltage for stopping boosting Vstop indicated by 5'. When the boosted voltage reaches the threshold voltage for stopping boosting Vstop, a boosting stopping signal 3' is output to a boosting switching control block 2' and the boosting switching control block 2' stops the boosting operation.

When the boosted voltage in the boosting capacitor C1 is consumed during opening of the fuel injection valve 105', the fuel injection control device 127' compares, with a comparator for recognizing a start of boosting Comp2, the voltage in the boosting capacitor C1 and a threshold voltage for starting boosting Vstart indicated by 6'. When the boosted voltage is equal to or lower than the threshold voltage for starting boosting Vstart, a boosting starting signal 4' is output to the boosting switching control block 2' and the boosting switching control block 2' starts the boosting operation.

Moreover, the boosting switching control block 2' monitors current, which flows in the boosting coil L1, with a current detecting resistor for monitoring a boosted current R1 and turns the switching element for boosting T1 on/off at a predetermined current threshold.

When opening the fuel injection valve 105' by applying current thereto, the fuel injection control device 127' monitors, with a fuel injection control block 8', an intake air amount, the number of engine revolutions, a water temperature, and an air-fuel ratio A/F which indicate a state of an engine. Then, the fuel injection control device 127' calculates an amount of fuel to be injected by the fuel injection valve 105' and timing of the injection and outputs a fuel injection driving pulse illustrated in FIG. 9 to a fuel injection valve driving circuit control block 7'. Based on a profile of a current to be applied to the fuel injection valve 105', the fuel injection valve driving circuit control block 7' that receives the fuel injection driving pulse controls the current applied to the fuel injection valve 105'. For example, first, a valve-opening current (hereinafter, referred to as Ipeak) to defeat high-pressure fuel is applied to the fuel injection valve 105'. Then, a first holding current (hereinafter, referred to as Ihold1) is continuously applied to the fuel injection valve 105' for a predetermined period and a second holding current (hereinafter, referred to as Ihold2) is subsequently applied thereto.

In a case of applying Ipeak to the fuel injection valve 105', the fuel injection control device 127' turns on switching elements T13 and T11. Accordingly, to both ends of the fuel injection valve 105', high voltage generated in the booster circuit is supplied from the boosting capacitor C1. Here, the fuel injection valve driving circuit control block 7' is monitored by a current detecting resistor for monitoring a fuel injection valve current R2. The boosting capacitor C1 keeps supplying the high voltage until a current value of the fuel injection valve 105' reaches Ipeak.

Also, in a section in which Ihold1 and Ihold2 are applied to the fuel injection valve 105', the fuel injection control device 127' performs control to apply a predetermined current to the fuel injection valve 105' by intermittently turning the switching element T12 on/off in a state in which the switching element T13 is turned on.

Moreover, when the voltage at both ends of the boosting capacitor C1 is decreased and becomes equal to or lower than the threshold voltage for starting boosting Vstart after the application of Ipeak, the fuel injection control device 127' starts a boosting operation performed by the booster circuit. When the voltage reaches the threshold voltage for stopping boosting Vstop, the fuel injection control device 127' stops the boosting operation performed by the booster circuit, keeps the boosted voltage constant, and prepares for next fuel injection.

However, in a case of applying current to the fuel injection valve 105' for a short period (that is, for example, in case of opening valve element for very short period in region of minimum injection amount and performing fuel injection) in the fuel injection control device including the above-described conventional booster circuit, a width of a fuel injection driving pulse to drive the fuel injection valve 105' becomes small and a decrease in the boosted voltage becomes small. Thus, as illustrated in FIG. 10, the boosted voltage does not become equal to or lower than the threshold voltage for starting boosting Vstart and current is applied, for next fuel injection, to the fuel injection valve 105' in a state in which a condition for starting boosting is not satisfied, whereby a behavior of the fuel injection valve 105' varies. More specifically, in the first application of current illustrated in FIG. 10, the boosted voltage reaches the threshold voltage for stopping boosting. However, since the boosted voltage is lower than the threshold voltage for stopping boosting although the boosted voltage is equal to or higher than the threshold voltage for starting boosting in the second application of current, a rising speed of the current is decreased. As a result, a problem that a difference ΔIpeak in a point reached by the current flowing in the fuel injection valve 105' (reached current value) is generated and that a fuel injection amount varies may be generated.

For example, with respect to such a problem, a technology for driving a fuel injection valve with a prescribed voltage in a case where next fuel injection is performed before timing of starting boosting in a booster circuit is disclosed in each of PTL 1 to PTL 3.

A booster circuit for driving an injector for a vehicle which circuit is disclosed in PTL 1 includes a plurality of capacitors to accumulate a boosted voltage, uses one capacitor for each time of fuel injection, and prepares for next injection by charging a different capacitor.

Also, an internal-combustion-engine fuel injection control device disclosed in PTL 2 includes a booster circuit to boost a voltage of a power supply, a capacitor which is charged by application of the boosted voltage, an injection starting timing setting unit to set injection starting timing of fuel injected from the fuel injection valve, an injection valve driving unit to open the fuel injection valve by supplying the power charged in the capacitor to the fuel injection valve at the set injection starting timing, and a boosting control unit which controls the boosting operation performed by the booster circuit in such a manner that the voltage of the capacitor is controlled to be a predetermined target value after the fuel injection valve is opened and which raises, immediately before the injection starting timing, the controlled voltage from the target value up to a predetermined upper limit value.

Also, an internal-combustion-engine fuel injection device disclosed in PTL 3 includes a booster circuit that supplies high voltage to open a fuel injection valve that directly supplies fuel into a combustion chamber of the internal-combustion-engine, and a boosting operation control circuit that performs on/off control of a boosting operation performed by the booster circuit. Based on a signal of driving the fuel injection valve, the boosting operation control circuit starts the boosting operation in the booster circuit when application of current to the fuel injection valve is started.

CITATION LIST

Patent Literature

PTL 1: Japanese Patent Application Laid-Open No. 2003-161193

PTL 2: Japanese Patent Application Laid-Open No. 2012-159025

PTL 3: Japanese Patent Application Laid-Open No. 2013-64363

SUMMARY OF INVENTION

Technical Problem

However, in a booster circuit for driving an injector disclosed in PTL 1, there is a problem that a plurality of capacitors is necessary, a fuel injection control device becomes larger, and a cost thereof becomes higher due to the increased number of parts.

Also, in the internal-combustion-engine fuel injection control device disclosed in PTL 2, immediately before injection starting timing, a voltage of a capacitor is raised from a state of being controlled to be a predetermined target value to a value that does not exceeds a predetermined upper limit. Thus, there is a problem that the voltage of the capacitor is raised immediately before fuel injection. Also, there are problems that it is not possible to deal with interruption injection or the like since it is necessary to know the injection starting timing previously and that a boosted voltage is decreased due to a leak of current in the booster circuit.

Moreover, in the internal-combustion-engine fuel injection device disclosed in PTL 3, a boosting operation in the booster circuit is started when application of current to a fuel injection valve is started based on a driving signal of the fuel injection valve. Thus, there is a remaining problem that a boosted voltage is decreased due to a leak of current in the booster circuit.

The present invention is provided in view of the forgoing and is to provide an internal-combustion-engine fuel injection control device which can accurately control a boosted voltage applied to a fuel injection valve during fuel injection (at start of application of current) and can control a variation in a fuel injection amount without increasing a size or a cost of the fuel injection control device even when a width of a fuel injection driving pulse to drive the fuel injection valve is small.

Solution to Problem

In order to solve the above problem, an internal-combustion-engine fuel injection control device according to the present invention includes: a booster circuit configured to generate voltage to open a fuel injection valve configured to directly supply fuel into a combustion chamber; and a voltage detection unit configured to detect an actual voltage in the booster circuit, a boosting operation being started when voltage detected by the voltage detection unit reaches a threshold voltage for starting boosting, and the boosting operation being stopped when the detected voltage reaches a threshold voltage for stopping boosting, wherein the fuel injection control device includes a boosting operation control unit configured to start the boosting operation at predetermined timing when the detected voltage is higher than the threshold voltage for starting boosting and is lower than the threshold voltage for stopping boosting.

Advantageous Effects of Invention

As it can be understood from the above description, according to the present invention, the boosting operation control unit configured to start the boosting operation at predetermined timing when the detected voltage in the booster circuit is higher than the threshold voltage for starting boosting and is lower than the threshold voltage for stopping boosting is included. Thus, for example, even in a case where a width of the fuel injection driving pulse to drive the fuel injection valve is small, a decrease in the boosted voltage is small, and the boosted voltage does not become lower than the threshold voltage for starting boosting, it is possible to start the boosting operation at predetermined timing, to accurately control a boosted voltage applied to the fuel injection valve during the fuel injection (at start of application of current), and to control a variation in the fuel injection amount without increasing a size or a cost of the fuel injection control device.

A problem, configuration, and effect other than what has been described above will be disclosed in a description of the following embodiments.

DESCRIPTION OF EMBODIMENTS

In the following, embodiments of an internal-combustion-engine fuel injection control device according to the present invention will be described with reference to the drawings.

[First Embodiment]

Figure 1:
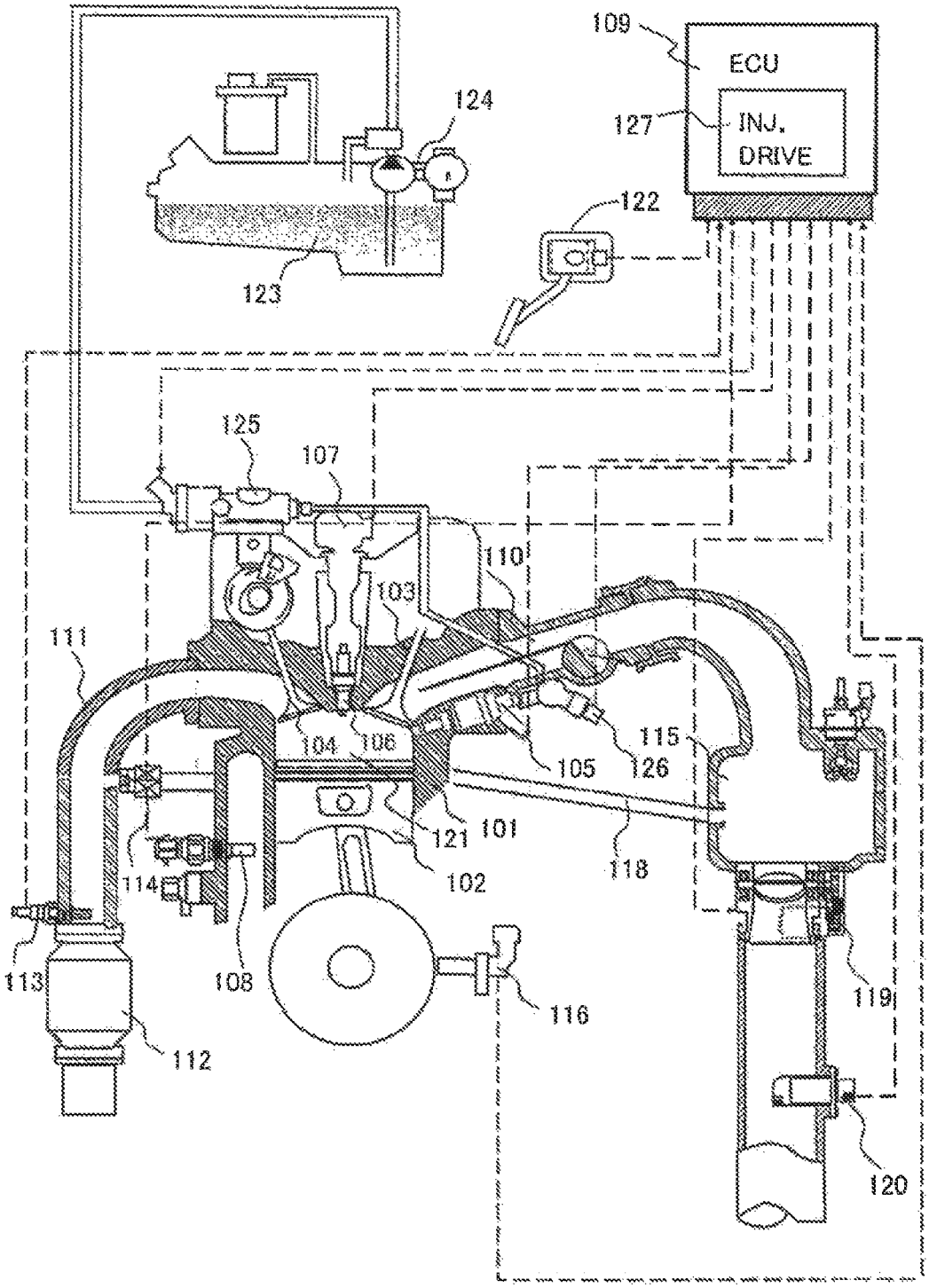
FIG. 1 is a whole configuration diagram schematically illustrating a whole configuration of an internal-combustion-engine including a first embodiment of an internal-combustion-engine fuel injection control device according to the present invention.

In FIG. 1, a whole configuration of an internal-combustion-engine including a first embodiment of an internal-combustion-engine fuel injection control device according to the present invention is schematically illustrated.

As illustrated in the drawings, an engine (internal-combustion-engine) 101 includes a piston 102, an intake valve 103, and an exhaust valve 104. After an amount of a flow of intake air necessary for combustion is measured by an air flow meter (AFM) 120, an amount of the air is adjusted by a throttle valve 119. Then, the air is supplied to a combustion chamber 121 of the engine 101 through a collector 115, an intake pipe 110, and the intake valve 103. Fuel is supplied from a fuel tank 123 to the engine 101 with a low-pressure fuel pump 124 and a pressure thereof is increased, by a high-pressure fuel pump 125, to a pressure with which fuel injection can be performed by a pressure in the combustion chamber 121 in a compression process. The high-pressure fuel is injected in a granular manner from a fuel injection valve 105 to the combustion chamber 121 of the engine 101 and is ignited by an ignition plug 106 energized by an ignition coil 107.

Exhaust gas after the combustion is exhausted to an exhaust pipe 111 through the exhaust valve 104 and is purified by a three-way catalyst 112. An engine control unit (ECU) 109 includes a fuel injection control device 127. To the ECU, a signal from a crank angle sensor 116 of the engine 101, a signal of an amount of air from the AFM 120, fuel pressure from a fuel pressure sensor 126, a signal from an oxygen sensor 113 to detect an oxygen concentration in exhaust gas, a signal from a water temperature sensor 108 for engine cooling water, and a signal of an accelerator position from an accelerator position sensor 122 are input. Based on the signal from the accelerator position sensor 122, the ECU 109 calculates torque required to the engine 101 and determines an idle state or the like of the engine 101. The ECU 109 includes a revolution detecting unit that calculates the number of engine revolutions based on the signal from the crank angle sensor 116. Also, the ECU 109 calculates an intake air amount necessary for the engine 101, performs control in such a manner that the throttle valve 119 is opened for a degree that matches the air amount, and further calculates an amount of necessary fuel. According to the calculated amount of necessary fuel, the fuel injection control device 127 outputs current, with which the fuel injection valve 105 performs fuel injection, for a period corresponding to a pressure of the fuel. Moreover, the ECU 109 outputs an ignition signal to ignite the ignition plug 106 at optimal timing.

Also, the exhaust pipe 111 and the collector 115 are connected to each other by an EGR passage 118. In a middle of the EGR passage 118, an EGR valve 114 is included. A degree of opening of the EGR valve 114 is controlled by the ECU 109. When necessary, the exhaust gas in the exhaust pipe 111 is returned to the intake pipe 110 through the EGR passage 118.

Figure 2:
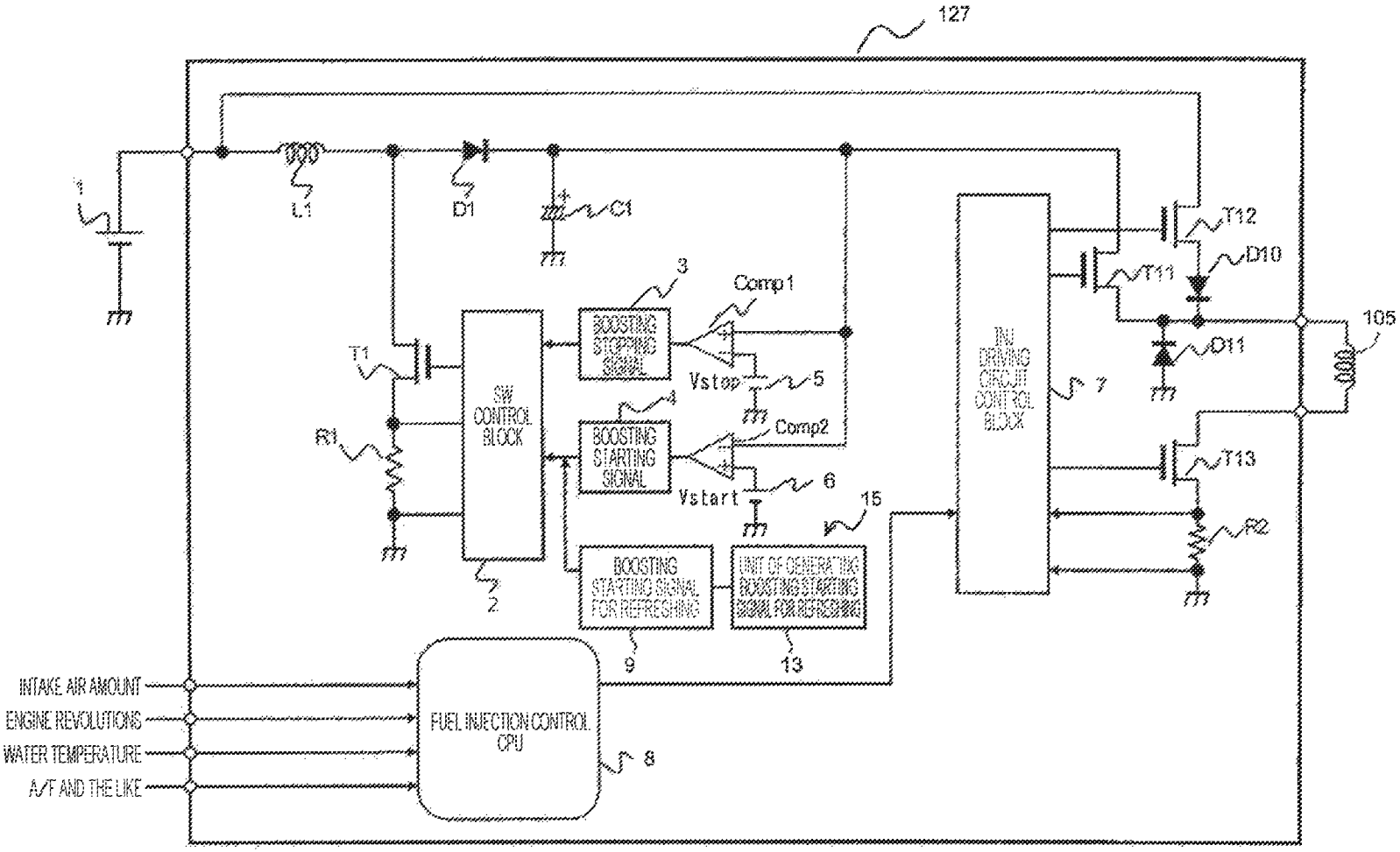
FIG. 2 is an internal configuration diagram illustrating a circuit configuration of the fuel injection control device illustrated in FIG. 1.
Figure 8:
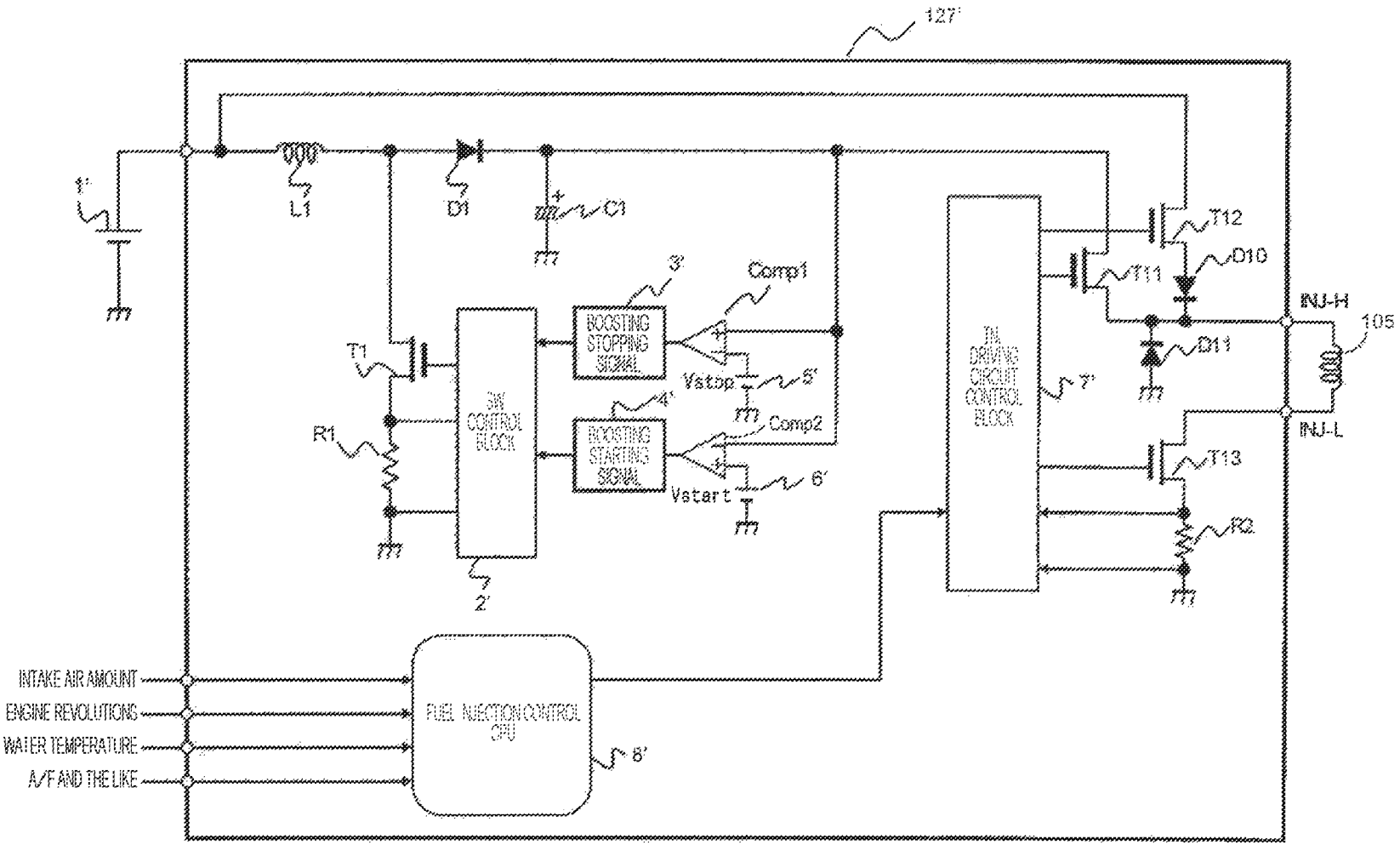
FIG. 8 is a configuration diagram illustrating a circuit configuration of a conventional fuel injection control device.
Figure 9:
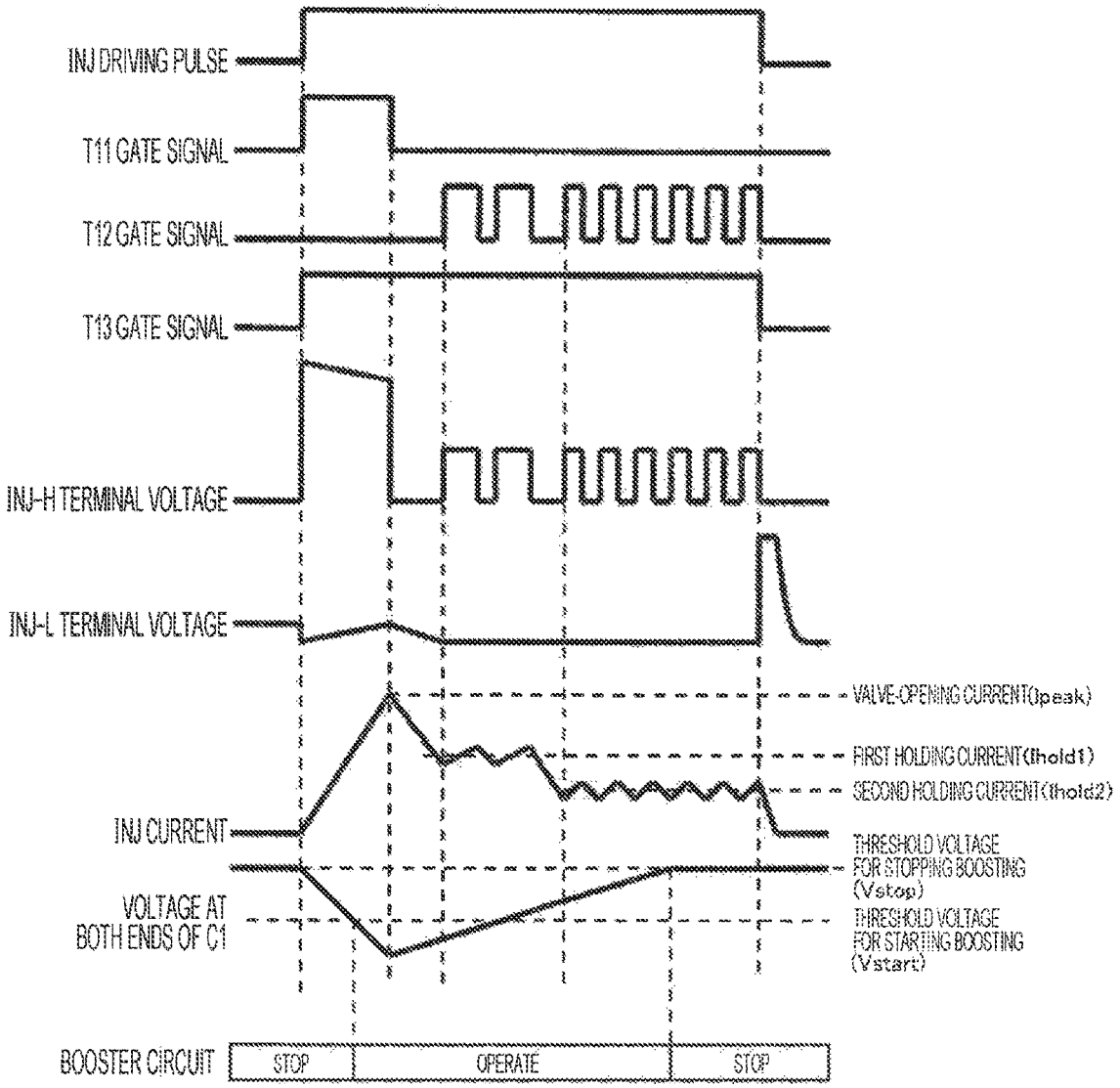
FIG. 9 is a time chart for describing an example of current/voltage control performed by the conventional fuel injection control device.
Figure 10:
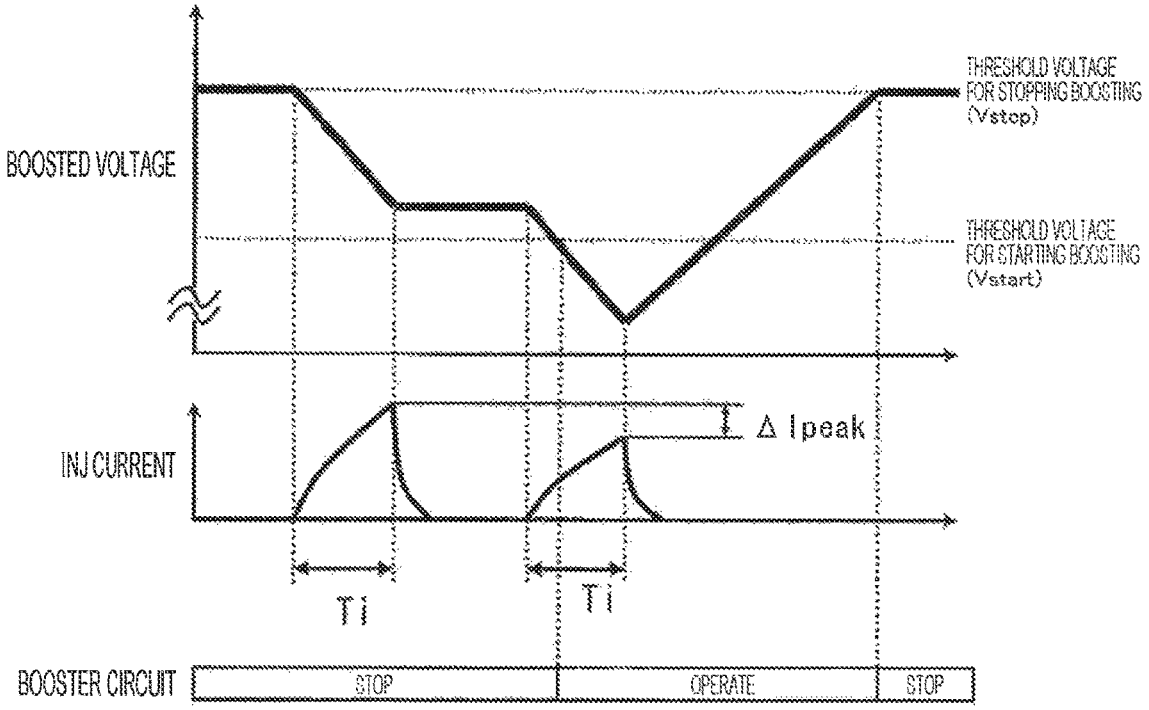
FIG. 10 is a time chart for describing a boosted voltage and an injection current in a fuel injection valve under voltage/current control performed by the conventional fuel injection control device.

In FIG. 2, a circuit configuration of the fuel injection control device illustrated in FIG. 1 is illustrated. As illustrated in the drawing, unlike the conventional fuel injection control device described with reference to FIG. 8, the fuel injection control device 127 of the first embodiment includes, in a booster circuit, a unit of generating a boosting starting signal for refreshing 13 (boosting operation control unit 15) to generate a boosting starting signal for refreshing 9 for starting a boosting operation at predetermined timing even when a boosted voltage does not become lower than a threshold voltage for starting boosting Vstart. Note that since a configuration of the fuel injection control device 127 other than the unit of generating a boosting starting signal for refreshing 13 is similar to that of the conventional fuel injection device illustrated in FIG. 8, a detail description thereof is omitted.

For example, when a voltage in the booster circuit (voltage detected by comparator for recognizing a start of boosting Comp2 which is voltage detection unit) is higher than a threshold voltage for starting boosting and is lower than a threshold voltage for stopping boosting, the unit of generating a boosting starting signal for refreshing 13 generates a pulsed boosting starting signal for refreshing 9 at predetermined timing and outputs the boosting starting signal for refreshing 9 to a boosting switching control block 2, whereby the fuel injection control device 127 starts a boosting operation with the booster circuit. Then, when a boosted voltage generated by a battery voltage reaches the threshold voltage for stopping boosting Vstop, the fuel injection control device 127 stops the boosting operation performed by the booster circuit.

Here, timing at which the unit of generating a boosting starting signal for refreshing 13 generates the boosting starting signal for refreshing 9 and outputs the signal to the boosting switching control block 2 can be set in the following manner according to a characteristic or the like required to the fuel injection control device 127.

For example, when the boosting starting signal for refreshing 9 is generated and output to the boosting switching control block 2 with a predetermined time interval, it is possible to make the booster circuit perform the boosting operation periodically and to securely prevent fuel injection in a state in which the boosted voltage is decreased.

Also, in a case of outputting the boosting starting signal for refreshing 9 with the predetermined time interval, fuel injection timing and timing of starting boosting are not synchronized. Thus, it is considered that the boosting operation is started by the booster circuit in a middle of the fuel injection. In such a case, the boosting operation may or may not be performed by the booster circuit in a middle of the fuel injection. Also, since timing at which the fuel injection timing and the timing of starting boosting overlap with each other varies, a value of current applied to the fuel injection valve may vary. Thus, it is considered that the boosting starting signal for refreshing 9 is generated and output to the boosting switching control block 2 with the predetermined time interval and that the timing of generating the boosting starting signal for refreshing 9 and outputting the signal is limited to timing at which voltage such as the battery voltage is not applied to the fuel injection valve 105.

Also, in consideration of timing of applying current to the fuel injection valve 105, the booster circuit is operated while timing of generating the boosting starting signal for refreshing 9 and outputting the signal to the boosting switching control block 2 is set as timing substantially-simultaneous with timing of applying the boosted voltage generated in the booster circuit to the fuel injection valve 105. Accordingly, it is possible to make the booster circuit perform the boosting operation faster than a case of operating the booster circuit after a boosted voltage becomes equal to or lower than the threshold voltage for starting boosting Vstart and to remarkably reduce a period of recovery of the boosted voltage.

Also, in a case where current in the fuel injection valve 105 is raised slowly and charging performance of the booster circuit is high, when the boosting starting signal for refreshing 9 is generated and the booster circuit is operated simultaneously with application of the boosted voltage to the fuel injection valve 105, the boosted voltage may reach the threshold voltage for stopping boosting Vstop immediately and the boosting operation performed by the booster circuit may be stopped. Thus, timing of generating the boosting starting signal for refreshing 9 and outputting the signal to the boosting switching control block 2 may be set as timing at which predetermined delay time passes after the boosted voltage generated in the booster circuit is applied to the fuel injection valve 105 and the boosting operation may be performed by the booster circuit after the predetermined delay time.

Also, it is considered that performance of the booster circuit is influenced by the voltage of the battery 1. Thus, when the boosting operation is performed by the booster circuit while the boosted voltage is applied to the fuel injection valve 105, a difference may be generated in rising of current in the fuel injection valve 105 according to voltage of the battery voltage. Thus, timing of generating the boosting starting signal for refreshing 9 and outputting the signal to the boosting switching control block 2 may be set as timing that is after application of the boosted voltage generated in the booster circuit to the fuel injection valve 105 is completed.

Moreover, for example, for synchronization with the number of engine revolutions or the fuel injection, timing of generating the boosting starting signal for refreshing 9 and outputting the signal to the boosting switching control block 2 may be set as timing simultaneous with application of voltage to the fuel injection valve 105 or as timing simultaneous with completion of application of voltage to the fuel injection valve 105.

Figure 3:
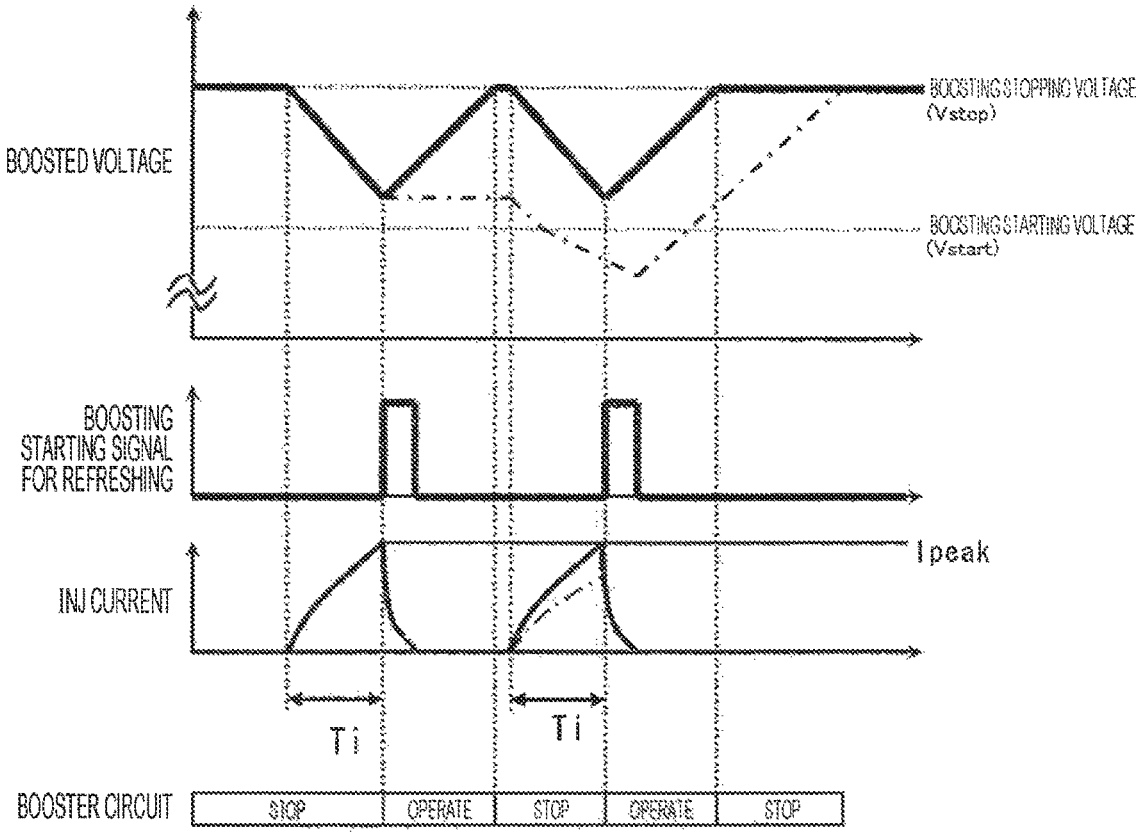
FIG. 3 is a time chart for describing a boosted voltage and an injection current in a fuel injection valve under voltage/current control performed by the fuel injection control device illustrated in FIG. 1.

In FIG. 3, a boosted voltage and an injection current in the fuel injection valve under voltage/current control performed by the fuel injection control device illustrated in FIG. 1 are described. Note that in FIG. 3, an example in which the boosting starting signal for refreshing 9 is output to the boosting switching control block 2 and the boosting operation is started by the booster circuit at timing simultaneous with application of the boosted voltage to the fuel injection valve 105, timing after predetermined delay time from application of the boosted voltage to the fuel injection valve 105, timing after completion of application of the boosted voltage to the fuel injection valve 105, or timing simultaneous with completion of application of voltage to the fuel injection valve 105 is illustrated. Also, in a graph of a boosted voltage and that of an INJ current in FIG. 3, solid lines respectively indicate a boosted voltage and an injection current in the fuel injection valve under voltage/current control by the fuel injection control device according to the first embodiment and dashed lines respectively indicate a boosted voltage and an injection current in a fuel injection valve under voltage/current control by the conventional fuel injection control device (see FIG. 8).

As illustrated in FIG. 3, a reached current value in the fuel injection valve is decreased in the second application of current in the conventional fuel injection control device. On the other hand, according to the fuel injection control device 127 of the first embodiment, the boosting starting signal for refreshing 9 is generated by the unit of generating a boosting starting signal for refreshing 13 at arbitrary timing and the boosting operation is started by the booster circuit, whereby it is possible to securely make the boosted voltage reach the threshold voltage for stopping boosting Vstop before the second application of current and to accurately make a reached current value in the second application of current identical to a reached current value in the first application of current.

In such a manner, according to the fuel injection control device 127 of the first embodiment, it is possible to start the boosting operation at predetermined timing and to make the boosted voltage reach the threshold voltage for stopping boosting before the next application of current regardless of an amount of voltage in the booster circuit even when a width of the fuel injection driving pulse to drive the fuel injection valve 105 is small, a decrease in the boosted voltage is small, and the boosted voltage does not become lower than the threshold voltage for starting boosting. Thus, it is possible to accurately control the boosted voltage applied to the fuel injection valve during the fuel injection (at start of application of current) and to control a variation in the fuel injection amount.

Note that in the above-described embodiment, a case where there is only one fuel injection valve 105 has been described to make a description easier to be understood. However, there are many cases where an actual fuel injection control device simultaneously controls a plurality of (four, for example) fuel injection valves and includes one booster circuit. In such cases, the first application of current and the second application of current are not always performed with respect to a fuel injection valve of the same cylinder. However, even when current is applied to fuel injection valves of different cylinders, with the above-described configuration, it is possible to control a variation in current applied to each of the fuel injection valves and to effectively control a variation in an amount of fuel injected from each fuel injection valve.

[Second Embodiment]

Figure 4:
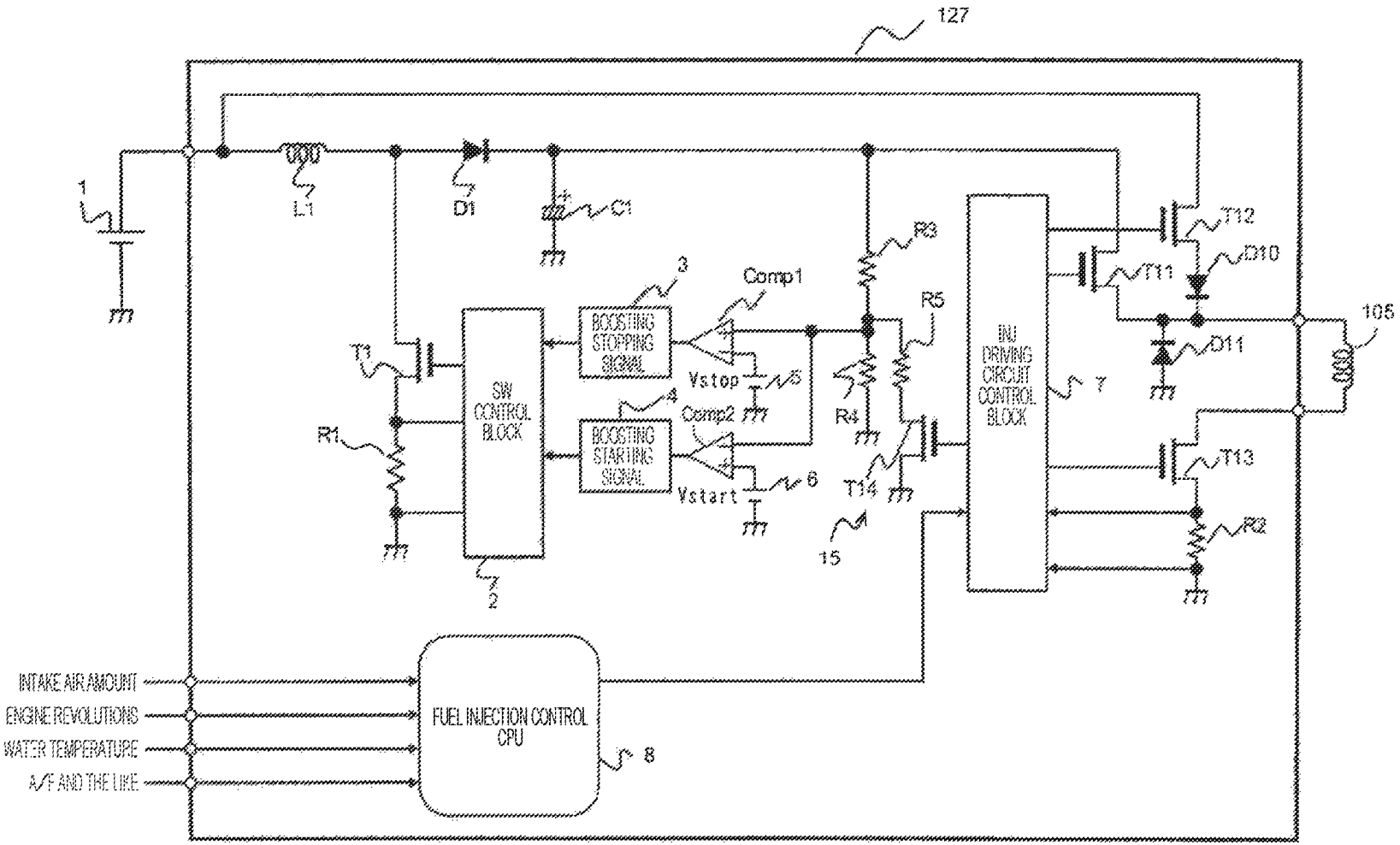
FIG. 4 is an internal configuration diagram illustrating a circuit configuration of a second embodiment of an internal-combustion-engine fuel injection control device according to the present invention.

In FIG. 4, a circuit configuration of a second embodiment of an internal-combustion-engine fuel injection control device according to the present invention is illustrated. The fuel injection control device of the second embodiment illustrated in FIG. 4 includes a boosting operation control unit a configuration of which is different from that of the fuel injection control device of the first embodiment. The other configuration of the fuel injection control device of the second embodiment is similar to that of the fuel injection control device of the first embodiment. Thus, the same reference sign is assigned to a configuration similar to that of the first embodiment and a detail description thereof is omitted.

In a fuel injection control device 127 of the second embodiment, a boosted voltage is divided and input in a circuit of monitoring (or detecting) the boosted voltage in order to reduce a withstanding pressure of an input voltage in a comparator for recognizing a stop of boosting Comp1 and a comparator for recognizing a start of boosting Comp2 for reduction of a production cost of a part. That is, illustrated resistors R3 and R4 are resistors to divide the boosted voltage. The voltage which is divided by the resistors R3 and R4 and is at a point of connection of the resistor R3 and the resistor R4 is monitored by the comparator for recognizing a stop of boosting Comp1 and the comparator for recognizing a start of boosting Comp2. Here, for example, a threshold voltage for stopping boosting Vstop and a threshold voltage for starting boosting Vstart become R4/(R3+R4) times higher than a threshold voltage for stopping boosting Vstop and a threshold voltage for starting boosting Vstart in a case where voltage is directly input which case is described with reference to FIG. 8.

In the above-described first embodiment, the boosting starting signal for refreshing 9 is output at predetermined timing regardless of the boosted voltage. However, in the second embodiment, a resistor R5 and a switching element T14, which are included in a boosting operation control unit 15, are further connected to GND at the point of connection of the resistor R3 and the resistor R4. Then, by suitable selection of resistance values of these resistors R3, R4, and R5, voltage at a point of connection of the resistors R3, R4, and R5 (apparent boosted voltage) is temporality made equal to or lower than the threshold voltage for starting boosting Vstart and a boosting operation is started when the switching element T14 is turned on.

In such a manner, according to the second embodiment, similarly to the first embodiment, it is possible to start a boosting operation at predetermined timing and to make a boosted voltage reach a threshold voltage for stopping boosting before the next application of current by performing on/off control of the switching element T14 instead of generating a boosting starting signal for refreshing 9 with the unit of generating a boosting starting signal for refreshing 13 of the first embodiment even when a width of a fuel injection driving pulse to drive a fuel injection valve 105 is small, a decrease in a boosted voltage is small, and the boosted voltage does not become lower than the threshold voltage for starting boosting. Thus, it is possible to accurately control a boosted voltage applied to the fuel injection valve during fuel injection and to control a variation in a fuel injection amount.

[Third Embodiment]

Figure 5:
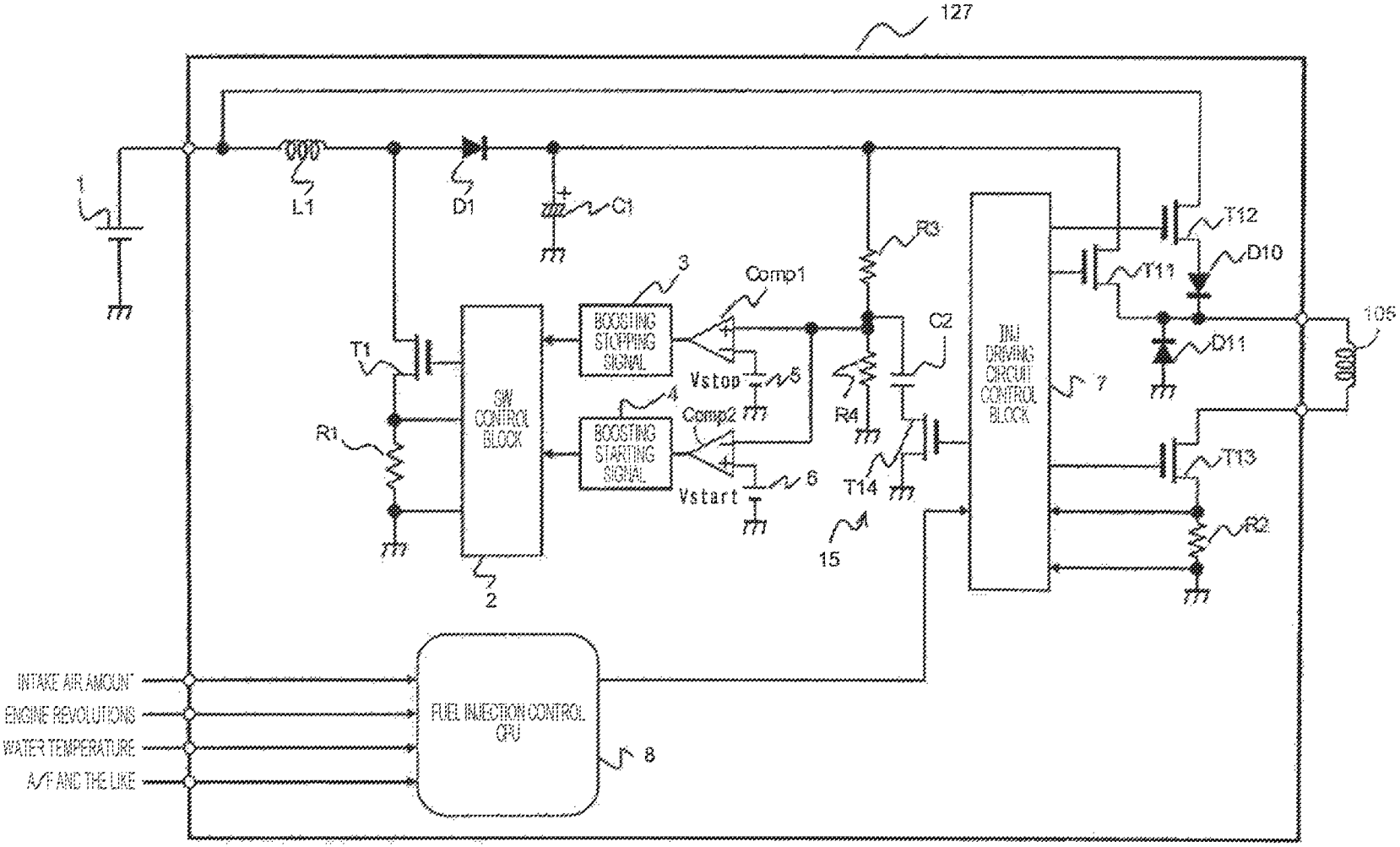
FIG. 5 is an Internal configuration diagram illustrating a circuit configuration of a third embodiment of an internal-combustion-engine fuel injection control device according to the present invention.

In FIG. 5, a circuit configuration of a third embodiment of an internal-combustion-engine fuel injection control device according to the present invention is illustrated. A fuel injection control device of the third embodiment illustrated in FIG. 5 includes a boosting operation control unit a configuration of which is different from that of the fuel injection control device of the second embodiment. The other configuration of the fuel injection control device of the third embodiment is similar to that of the fuel injection control device of the second embodiment. Thus, the same reference sign is assigned to a configuration similar to that of the second embodiment and a detail description thereof is omitted.

In a fuel injection control device 127 of the third embodiment, a capacitor C2 is used instead of the resistor R5 for changing a voltage division ratio in the second embodiment.

In the fuel injection control device 127, a switching element T14 is being off in normal time and the capacitor C2 is kept in a not-charged state. Here, in a case of operating a booster circuit regardless of an amount of a boosted voltage, when the switching element T14 is turned on, voltage at a connection point which voltage is divided by resistors R3 and R4 is decreased until the capacitor C2 is charged. Accordingly, a comparator for recognizing a start of boosting Comp2 recognizes that a boosted voltage becomes equal to or lower than the threshold voltage for starting boosting Vstart. Thus, a boosting operation is started regardless of an amount of the boosted voltage.

In such a manner, according to the third embodiment, similarly to the first and second embodiments, it is possible to start a boosting operation at predetermined timing and to make a boosted voltage reach a threshold voltage for stopping boosting before the next application of current by performing on/off control of the switching element T14 instead of generating a boosting starting signal for refreshing 9 with the unit of generating a boosting starting signal for refreshing 13 of the first embodiment even when a width of a fuel injection driving pulse to drive a fuel injection valve 105 is small, a decrease in a boosted voltage is small, and the boosted voltage does not become lower than the threshold voltage for starting boosting. Thus, it is possible to accurately control a boosted voltage applied to the fuel injection valve during fuel injection and to control a variation in a fuel injection amount.

Also, according to the third embodiment, there is an advantage that a booster circuit can be operated safely even when the switching element T14 is broken in an on-state in a case where a capacity of the capacitor C2 is set as an adequately-small value with respect to a variation of the boosted voltage.

[Fourth Embodiment]

Figure 6:
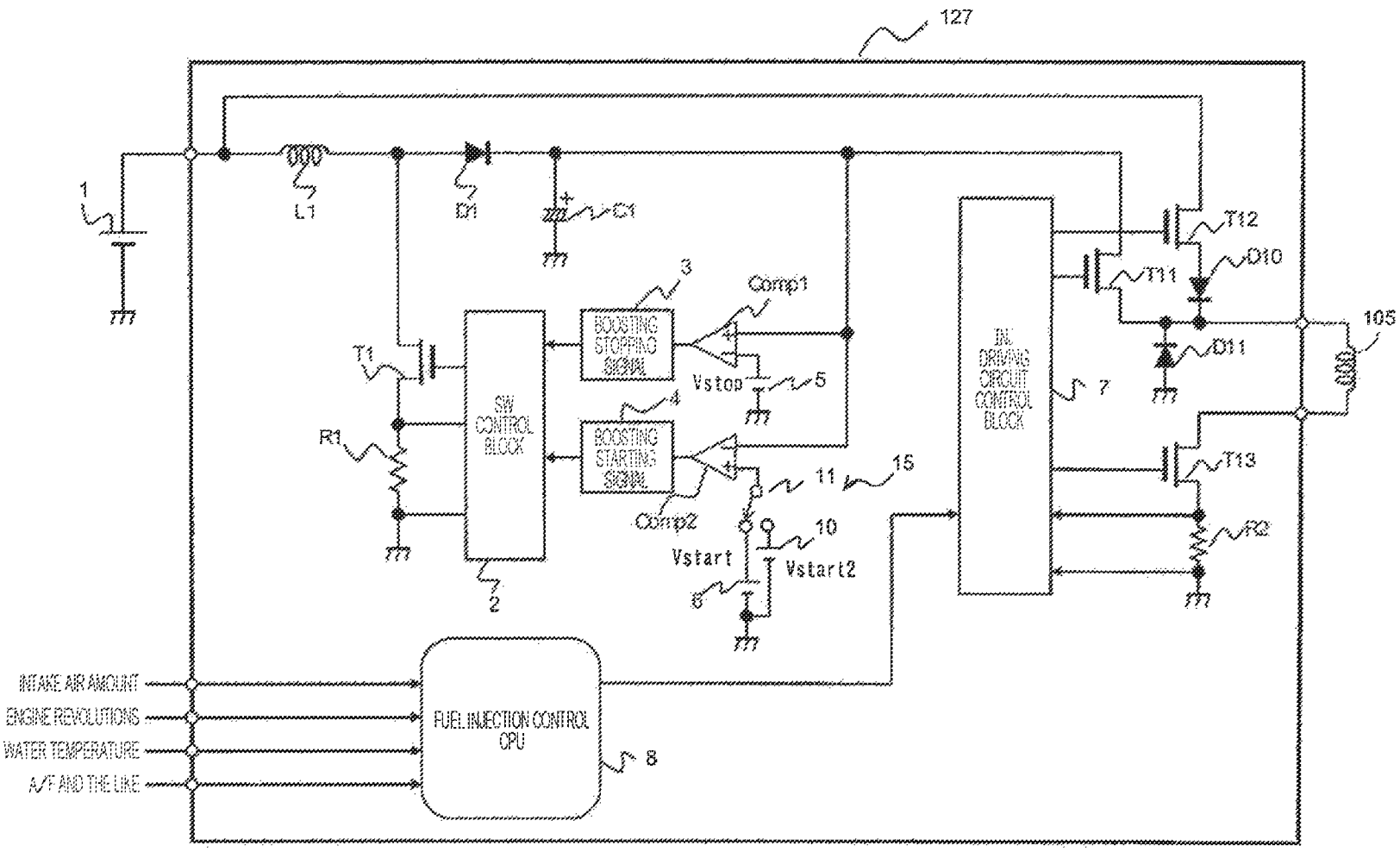
FIG. 6 is an internal configuration diagram illustrating a circuit configuration of a fourth embodiment of an internal-combustion-engine fuel injection control device according to the present invention.

In FIG. 6, a circuit configuration of a fourth embodiment of an internal-combustion-engine fuel injection control device according to the present invention is illustrated. A fuel injection control device of the fourth embodiment illustrated in FIG. 6 includes a boosting operation control unit a configuration of which is different from those of the fuel injection control devices of the first to third embodiments. The other configuration of the fuel injection control device of the fourth embodiment is similar to those of the fuel injection control devices of the first to third embodiments. Thus, the same reference sign is assigned to a configuration similar to those of the first to third embodiments and a detail description thereof is omitted.

In the fuel injection control device 127 of the fourth embodiment, for a comparison of an input voltage in a comparator for recognizing a start of boosting Comp2, a different threshold voltage for starting boosting 2Vstart2 indicated by 10 is set in addition to a threshold voltage for starting boosting Vstart indicated by 6, that is, two kinds of threshold voltages for starting boosting which voltages have different voltage values are set. Then, voltage to be a target of a comparison in the comparator for recognizing a start of boosting Comp2 is switched by a switch for switching a threshold voltage for starting boosting 11 included in a boosting operation control unit 15. Here, for example, the threshold voltage for starting boosting 2Vstart2 is set equal to or higher than the threshold voltage for stopping boosting Vstop and a priority in the boosting operation is a boosting stopping signal 3>a boosting starting signal 4.

In the fuel injection control device 127, the switch for switching a threshold voltage for starting boosting 11 is switched to a side of the threshold voltage for starting boosting Vstart indicated by 6 in normal time, a boosting operation is performed by utilization of the threshold voltage for starting boosting Vstart, and the boosting operation is stopped by utilization of the threshold voltage for stopping boosting Vstop.

On the other hand, in a case of starting the boosting operation regardless of an amount of the boosted voltage, the switch for switching a threshold voltage for starting boosting 11 is temporarily switched to a side of the threshold voltage for starting boosting 2Vstart2 at the timing, the threshold voltage for starting boosting 2Vstart2 is selected from two kinds of threshold voltages for starting boosting, and the boosting operation is started by a booster circuit.

In such a manner, according to the fourth embodiment, similarly to the first to third embodiments, it is possible to start a boosting operation at predetermined timing and to make a boosted voltage reach a threshold voltage for stopping boosting before the next application of current by switching the switch for switching a threshold voltage for starting boosting 11 and selecting an arbitrary threshold voltage for starting boosting instead of generating a boosting starting signal for refreshing 9 with the unit of generating a boosting starting signal for refreshing 13 of the first embodiment even when a width of a fuel injection driving pulse to drive a fuel injection valve 105 is small, a decrease in a boosted voltage is small, and the boosted voltage does not become lower than the threshold voltage for starting boosting. Thus, it is possible to accurately control a boosted voltage applied to the fuel injection valve during fuel injection and to control a variation in a fuel injection amount.

[Fifth Embodiment]

Figure 7:
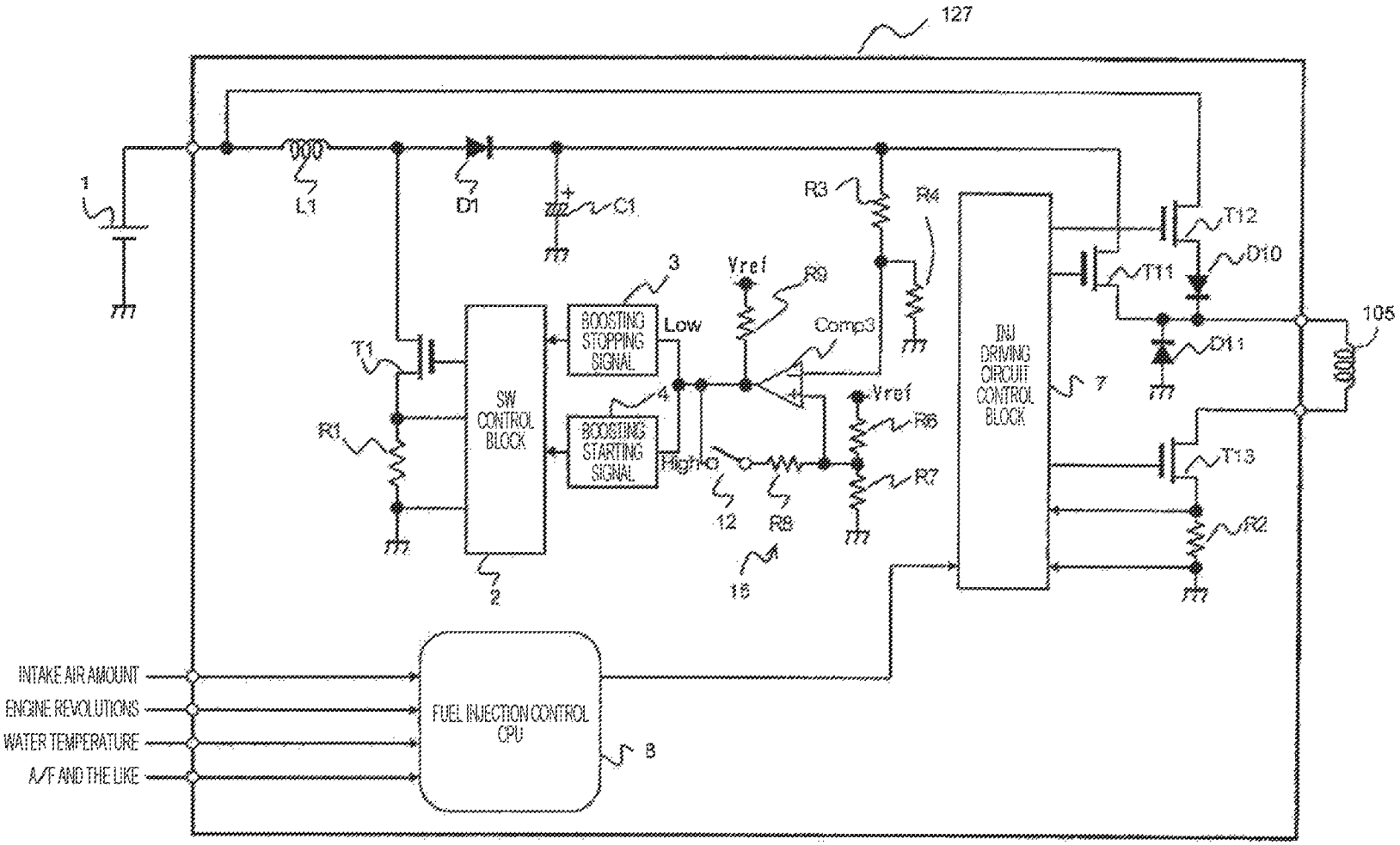
FIG. 7 is an internal configuration diagram illustrating a circuit configuration of a fifth embodiment of an internal-combustion-engine fuel injection control device according to the present invention.

In FIG. 7, a circuit configuration of a fifth embodiment of an internal-combustion-engine fuel injection control device according to the present invention is illustrated. A fuel injection control device of the fifth embodiment illustrated in FIG. 7 includes a boosting operation control unit a configuration of which is different from those of the fuel injection control devices of the first to fourth embodiments. The other configuration of the fuel injection control device of the fifth embodiment is similar to those of the fuel injection control devices of the first to fourth embodiments. Thus, the same reference sign is assigned to a configuration similar to those of the first to fourth embodiments and a detail description thereof is omitted.

In a fuel injection control device 127 of the fifth embodiment, a comparison at a start of boosting and a comparison at a stop of the boosting are performed by one comparator and a threshold voltage for starting boosting Vstart is controlled by a comparator circuit with hysteresis (hereinafter, referred to as comparator for recognizing start/stop of boosting Comp3) with respect to a threshold voltage for stopping boosting Vstop.

In the fuel injection control device 127 of the fifth embodiment, a boosting operation control unit 15 to control a start of a boosting operation mainly includes the comparator for recognizing a start/stop of boosting Comp3, resistors R3 and R4 to divide a boosted voltage, resistors R6, R7, R8, and R9 to prescribe a threshold voltage for starting/stopping boosting, a switch for switching boosting control voltage hysteresis 12 inserted between the resistor R8 and an output terminal of the comparator for recognizing a start/stop of boosting Comp3. When the switch 12 is opened, there is no hysteresis. When the switch 12 is closed, there is hysteresis.

In the fifth embodiment, the switch for switching boosting control voltage hysteresis 12 is closed and there is no hysteresis in normal time. On the other hand, in a case of starting a boosting operation regardless of an amount of a boosted voltage, the switch for switching boosting control voltage hysteresis 12 is opened and the boosting operation is started by a booster circuit when the boosted voltage is lower than the threshold voltage for stopping boosting Vstop.

In such a manner, according to the fifth embodiment, similarly to the first to fourth embodiments, it is possible to start a boosting operation at predetermined timing and to make a boosted voltage reach a threshold voltage for stopping boosting before the next application of current by switching the switch for switching boosting control voltage hysteresis 12 and making hysteresis of a threshold voltage for starting boosting ineffective instead of generating a boosting starting signal for refreshing 9 with the unit of generating a boosting starting signal for refreshing 13 of the first embodiment even when a width of a fuel injection driving pulse to drive a fuel injection valve 105 is small, a decrease in a boosted voltage is small, and the boosted voltage does not become lower than the threshold voltage for starting boosting. Thus, it is possible to accurately control a boosted voltage applied to the fuel injection valve during fuel injection and to control a variation in a fuel injection amount.

Note that the present invention is not limited to the above-described first to fifth embodiments. The present invention includes various modified forms. For example, the first to fifth embodiments are described in detail to make the present invention easier to be understood. Not all of the above-described configurations are necessarily included. Also, it is possible to replace a part of a configuration of an embodiment with a configuration of a different embodiment and to add a configuration of a different embodiment to a configuration of an embodiment. Also, with respect to a part of a configuration of each embodiment, addition, deletion, or replacement of a different configuration can be performed.

Also, a control line and an information line considered to be important for a description is illustrated and not all control lines and information lines of a product are necessarily illustrated. It can be considered that almost all configurations are connected to each other in reality.

REFERENCE SIGNS LIST

1 battery
2 boosting switching control block
3 boosting stopping signal
4 boosting starting signal
5 threshold voltage for stopping boosting Vstop
6 threshold voltage for starting boosting Vstart
7 fuel injection valve driving circuit control block
8 fuel injection control block
9 boosting starting signal for refreshing
10 threshold voltage for starting boosting 2Vstart2
11 switch for switching threshold voltage for starting boosting
12 switch for switching boosting control voltage hysteresis
13 unit of generating boosting starting signal for refreshing
15 boosting operation control unit
101 engine (internal-combustion-engine)
102 piston
103 intake valve
104 exhaust valve
105 fuel injection valve
106 ignition plug
107 ignition coil
108 water temperature sensor
109 engine control unit (ECU)
110 intake pipe
111 exhaust pipe
112 three-way catalyst
113 oxygen sensor
114 EGR valve
115 collector
116 crank angle sensor
118 EGR passage
119 throttle valve
120 air flow meter (AFM)
121 combustion chamber
122 accelerator position sensor
123 fuel tank
124 low-pressure fuel pump
125 high-pressure fuel pump
126 fuel pressure sensor
127 fuel injection control device
C1 boosting capacitor
C2 capacitor
D1 boosting diode
L1 boosting coil
R1 current detecting resistor for monitoring boosted current
R2 current detecting resistor for monitoring fuel injection valve current
T1 switching element for boosting
T11, T12, T13, T14 switching element
Comp1 comparator for recognizing stop of boosting
Comp2 comparator for recognizing start of boosting
Comp3 comparator for recognizing start/stop of boosting
D10, D11 diode
R3, R4, R5, R6, R7, R8, R9 resistor

The invention claimed is:

1. An internal-combustion-engine fuel injection control device comprising:

a booster circuit configured to generate a boosted voltage that opens a fuel injection valve, the fuel injection valve being configured to directly supply fuel into a combustion chamber;

a boosting operation control unit; and a voltage detection unit configured to detect an actual voltage in the booster circuit, wherein a boosting operation is started when the actual voltage detected by the voltage detection unit reaches a first threshold voltage that triggers a start of boosting, the boosting operation is stopped when the actual voltage detected by the voltage detection unit reaches a second threshold voltage for stopping boosting, the boosting operation control unit is configured to start the boosting operation at a predetermined timing, and the boosting operation is started without regard to a timing of a fuel injection, the boosting operation control unit includes a circuit configured to temporarily change a value of the actual voltage detected by the voltage detection unit to a value that is lower than the first threshold voltage that triggers the start of boosting by dividing the boosted voltage and providing a divided portion of the boosted voltage to the voltage detection unit, and the circuit includes a first resistor and a switching element that are connected to GND at a connection point of a second and third resistor configured to divide the boosted voltage.

2. The internal-combustion-engine fuel injection control device according to claim 1, wherein the fuel injection control device includes a plurality of threshold voltages for starting boosting which voltages have different voltage values, and the boosting operation control unit includes a switch for switching a threshold voltage for starting boosting which switch is configured to switch which of the plurality of threshold voltages for starting boosting is selected.

3. The internal-combustion-engine fuel injection control device according to claim 1, wherein the circuit is configured to start the boosting operation when the detected voltage is lower than the threshold voltage for stopping boosting.

4. The internal-combustion-engine fuel injection control device according to claim 1, wherein the predetermined timing is repeatedly set with a predetermined time interval passing between each setting of the timing.

5. The internal-combustion-engine fuel injection control device according to claim 4, wherein the predetermined timing is timing at which voltage is not applied to the fuel injection valve.

6. The internal-combustion-engine fuel injection control device according to claim 1, wherein the predetermined timing is timing at which voltage generated in the booster circuit is applied to the fuel injection valve.

7. The internal-combustion-engine fuel injection control device according to claim 1, wherein the predetermined timing is timing at which predetermined delay time is elapsed from application of voltage generated in the booster circuit to the fuel injection valve.

8. The internal-combustion-engine fuel injection control device according to claim 1, wherein the predetermined timing is timing after application of voltage generated in the booster circuit to the fuel injection valve is over.

9. The internal-combustion-engine fuel injection control device according to claim 1, wherein the predetermined timing is timing at which voltage is applied to the fuel injection valve.

10. The internal-combustion-engine fuel injection control device according to claim 1, wherein the predetermined timing is timing at which application of voltage to the fuel injection valve is over.

* * * * *